US007836726B2

(12) United States Patent
Picardi

(10) Patent No.: US 7,836,726 B2
(45) Date of Patent: Nov. 23, 2010

(54) PIECE OF JEWELLERY WITH SPECIAL AESTHETIC EFFECTS

(75) Inventor: Raffaele Picardi, Valenza (IT)

(73) Assignee: Dress Your Body, S.A., Bienne (CH)

( * ) Notice: Subject to any disclaimer, the term of this patent is extended or adjusted under 35 U.S.C. 154(b) by 349 days.

(21) Appl. No.: 11/610,989

(22) Filed: Dec. 14, 2006

(65) Prior Publication Data

US 2007/0151295 A1 Jul. 5, 2007

(30) Foreign Application Priority Data

Dec. 16, 2005 (EP) ..... 05027633

(51) Int. Cl.
*A44C 9/00* (2006.01)

(52) U.S. Cl. ..... 63/15.1; 63/33

(58) Field of Classification Search ..... None
See application file for complete search history.

(56) References Cited

U.S. PATENT DOCUMENTS 221,728 A * 11/1879 Halsey ..... 63/15.4
1,586,606 A 6/1926 Cain
2,060,345 A * 11/1936 Phillips ..... 63/3
2,158,156 A * 5/1939 Heinrich ..... 384/492
6,574,989 B1 * 6/2003 Lampert ..... 63/15
2001/0020369 A1 * 9/2001 Hirano ..... 63/15.4

OTHER PUBLICATIONS

European Search Report issued in corresponding application No. EP 05 02 7633, completed Feb. 28, 2006.

* cited by examiner

*Primary Examiner*—Jack W. Lavinder
(74) *Attorney, Agent, or Firm*—Griffin & Szipl, P.C.

(57) ABSTRACT

Piece of jewellery including an outer ring (2) and an inner ring (4) arranged concentrically to the outer ring (2), the two inner (4) and outer (2) rings being able to pivot in relation to each other, the outer ring (2) comprising at least one aperture (6) through which at least one decoration (8), provided on the outer periphery of the inner ring (4), can appear, means being provided for the axial coupling of the two inner (4) and outer (2) rings, this piece of jewellery being characterized in that the axial coupling means include at least one ball (10) arranged in a housing (12) disposed on the external periphery of the inner ring (4) and capable of rolling in the inner periphery of the outer ring (2) and forming a rolling path for the ball (10).

14 Claims, 3 Drawing Sheets

PIECE OF JEWELLERY WITH SPECIAL AESTHETIC EFFECTS

This application claims priority from European Patent Application No. 05027633.6 filed Dec. 16, 2005, the entire disclosure of which is incorporated herein by reference.

The present invention concerns a piece of jewellery with special aesthetic effects. It concerns more specifically the field of rings to be worn on the finger and bracelets worn on the wrist. It may also concern earrings, pendants, cufflinks or key rings. More generally, the invention concerns any type of piece of jewellery comprising an external ring and an internal ring arranged coaxially to the external ring, the two rings being able to rotate in relation to each other.

A ring worn on the finger is known from U.S. Pat. No. 221,728 in the name of Halsey. This ring is formed of two respectively inner and outer rings, the inner ring being arranged concentrically to the outer ring. The outer ring is pivotably mounted on the inner ring and comprises apertures allowing portions of the inner ring to be seen. By rotating the outer ring relative to the inner ring, different portions of the inner ring are made to appear, which gives the Halsey ring a changing appearance.

In accordance with the Halsey invention, the inner ring includes on its external periphery a groove for cooperating with a stud provided on the inner periphery of the outer ring. During assembly, the outer ring is slid over the inner ring, the stud being resiliently deformed until it returns to its initial shape by projecting into the groove of the inner ring. At that moment, the two rings are axially coupled and able to pivot in relation to each other.

Halsey's invention has the advantage of providing a jewellery ring whose appearance can be altered as desired by the person wearing it. In fact, the inner ring bears different decorative designs that can be selected by moving the apertures made in the outer ring to face the design that one wishes to appear. However, the axial coupling of the two inner and outer rings via the stud does not guarantee an assembly that cannot be taken to pieces. Indeed, one only needs to exert a certain pushing force on one of the rings to force the stud to deform again resiliently, the effect of which is to separate the two rings. Moreover, when the outer ring is rotated relative to the inner ring, the stud moves by sliding along the groove, rubbing against the bottom of the latter. This friction gives the wearer an impression of mediocre quality, which is not compatible with a piece of jewellery with which the notions of luxury and high quality are usually associated.

It is thus an object of the present invention to overcome the aforementioned drawbacks, in addition to others, by providing a piece of jewellery with special aesthetic effects providing the wearer with an impression of high quality.

The present invention therefore concerns a piece of jewellery including an outer ring and an inner ring arranged concentrically to the outer ring, the two inner and outer rings being able to pivot in relation to each other, the outer ring comprising at least one aperture through which at least one decoration, provided on the outer periphery of the inner ring, can appear, means being provided for the axial coupling of the two inner and outer rings, this piece of jewellery being characterized in that the axial coupling means include at least one ball arranged in a housing adjacent one end of the outer periphery of the inner ring and capable of rolling in an annular rolling path arranged in the inner periphery of the outer ring.

Owing to these features, the present invention provides a piece of jewellery with special aesthetic effects including two outer and inner rings able to pivot in relation to each other, the outer ring rolling over the inner ring via the ball. This rolling occurs smoothly, requiring the same force from the wearer, whatever the relative position of the two rings and the direction of pivoting, which gives the wearer an increased sense of quality.

According to a complementary feature of the invention, the axial coupling means of the two inner and outer rings further comprise at least one pivot which can either be carried by one of the inner and outer rings or the other and which travels in a circular groove arranged in the opposite ring.

According to a first variant, the pivot is driven into one or other of the inner and outer rings. The two inner and outer rings are thus totally unable to be separated after assembly, even if an axial pushing force is applied to one or other of the two rings. The risk of the piece of jewellery being ruined and one of the two rings being lost is thus totally avoided.

It may occur, however, that dirt such as dust, grains of sand or suchlike becomes mixed between the two rings by passing through the apertures of the outer ring and blocks the operation of the rings.

This is why, according to a second variant of the invention, the pivot is secured in a removable manner, for example by being screwed, onto the ring concerned. The piece of jewellery can thus only be dismantled by a jeweller with an appropriate tool, who can dismantle the pivot, then move the rings slightly apart. After which, provided for example with bellows, the jeweller can remove the dirt that is interfering with the working of the rings.

Other features and advantages of the present invention will appear more clearly upon reading the following detailed description of an example embodiment of the piece of jewellery according to the invention, this example being given purely by way of non-limiting illustration, in conjunction with the annexed drawing, in which.

Figure 1A:
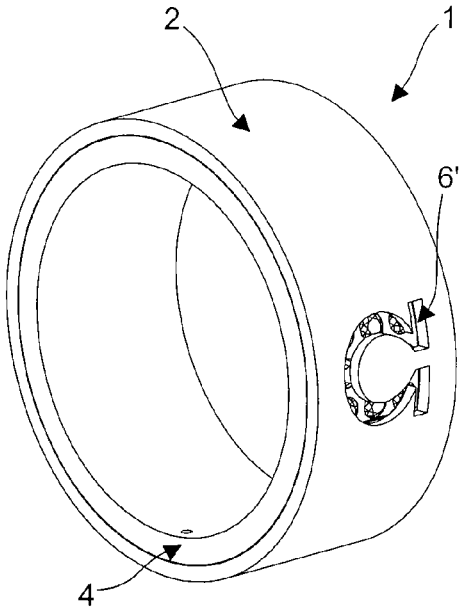
FIGS. 1A and 1B are perspective views of the ring according to the invention showing the two apertures of the outer ring arranged opposite two different decorations provided on the inner ring.
Figure 1B:
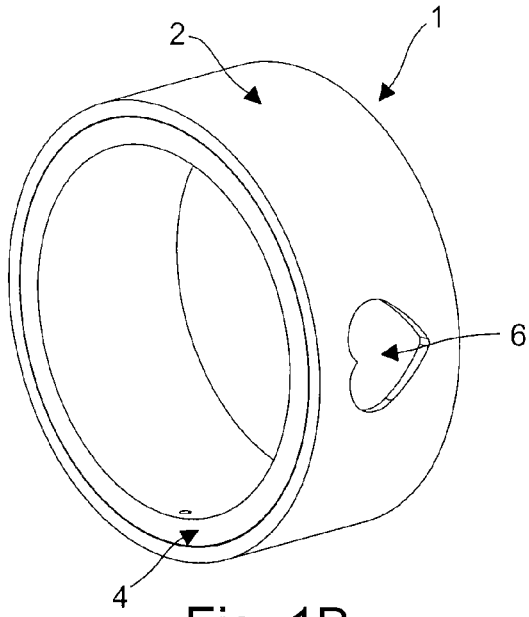
Figure 2:
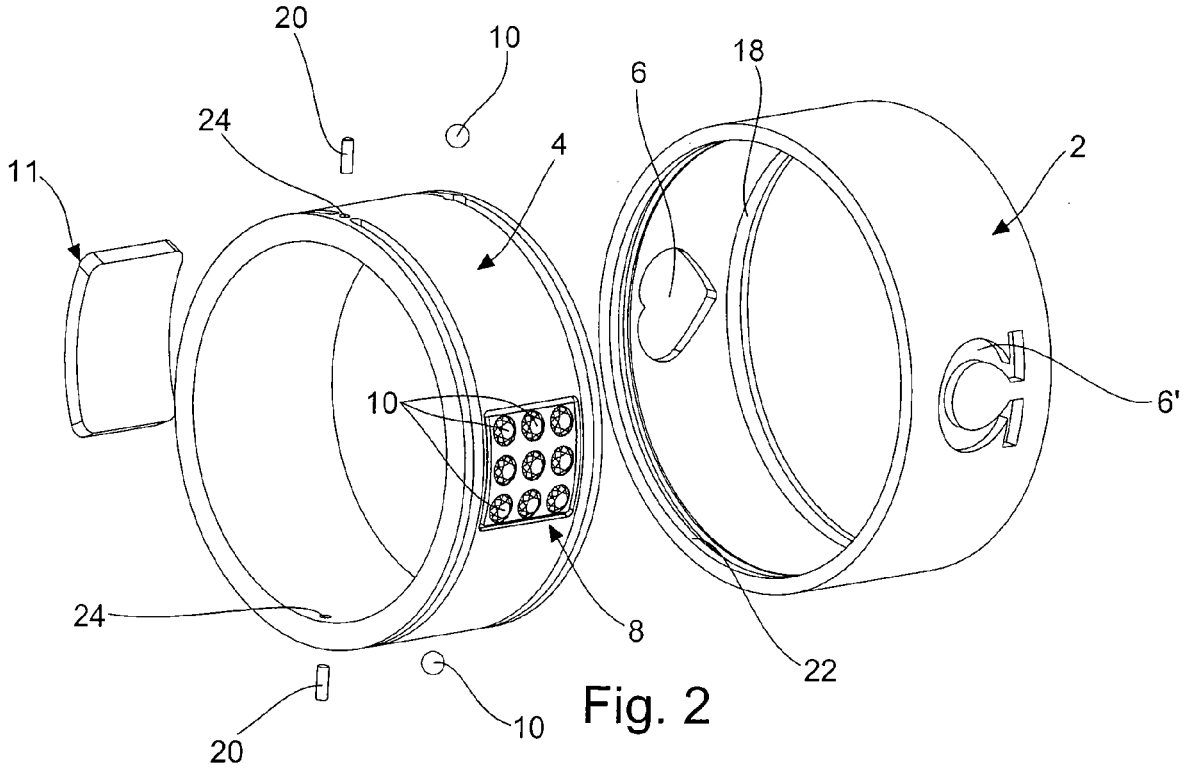
FIG. 2 is a perspective exploded view of the ring according to the invention.

The present invention will be described in conjunction with a ring to be worn on the finger. It goes without saying that this example is given purely by way of non-limiting illustration, the present invention also being able to apply for example to a bracelet worn on the wrist or to any other object comprising two concentric rings.

The ring of the invention, designated as a whole by the general reference numeral 1, essentially includes an outer ring 2 and an inner ring 4 arranged concentrically to outer ring 2. As will be understood more clearly upon reading the following description, the two outer 2 and inner 4 rings are able to pivot in relation to each other.

The outer ring 2 includes at least one aperture 6 through which a decoration 8 is visible, provided on the external periphery of inner ring 4. In the example shown in the drawing, outer ring 2 comprises two apertures 6 and 6', one 6 of which is for example heart-shaped, and the other 6, has the shape of the Greek capital letter Ω. It goes without saying that these examples are given purely by way of illustration and that the number and shape of the apertures can be varied. As regards decoration 8, provided on the outer periphery of inner ring 4, this may be of any desired type. In the example shown in the drawing, this decoration 8 is formed of a plurality of diamonds 10 set in the thickness of inner ring 4. However, one could also envisage this decoration 8 being formed by an area made in a material of a different colour from the rest of the ring, for example a decoration 8 in white gold arranged at one place on the periphery of inner ring 4, which is itself made of yellow gold or an enamelled decoration 11. The object of the invention is, let us not forget, to select a different area of inner ring 4 visible through the aperture(s) arranged in outer ring 2, by rotating outer ring 2 in relation to inner ring 4, to alter the appearance of ring 1.

Figure 3:
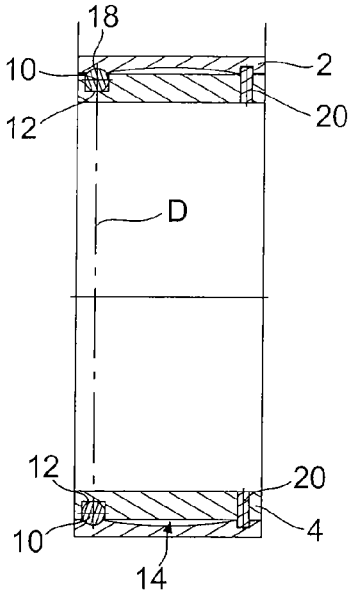
FIGS. 3 and 4 are transverse cross-sections of the ring according to the invention, the cross-section of FIG. 4 passing through a decorative design carried by the inner ring and an aperture of the outer ring.
Figure 4:
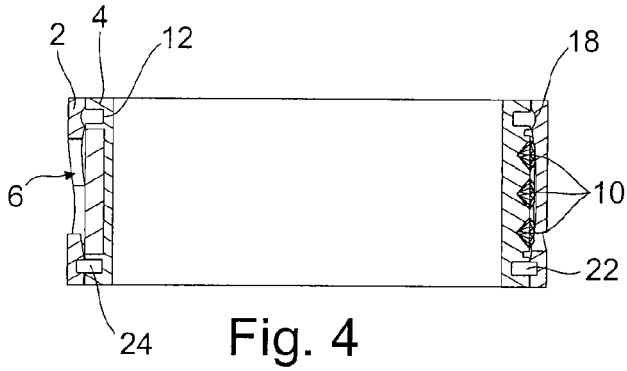
Figure 5:
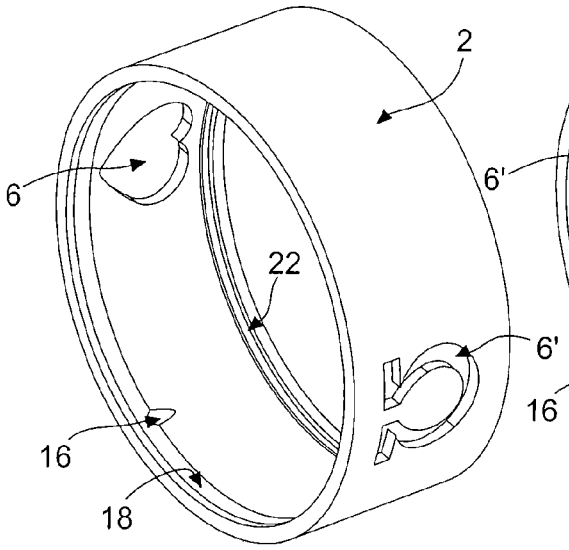
FIGS. 5 and 6 are perspective view of the outer ring, the outer rings as shown in FIG. 6 being pivoted by 180° in relation to FIG. 5.
Figure 6:
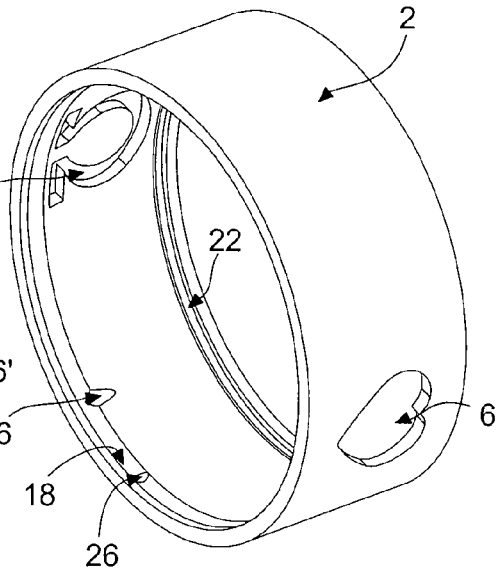
Figure 7:
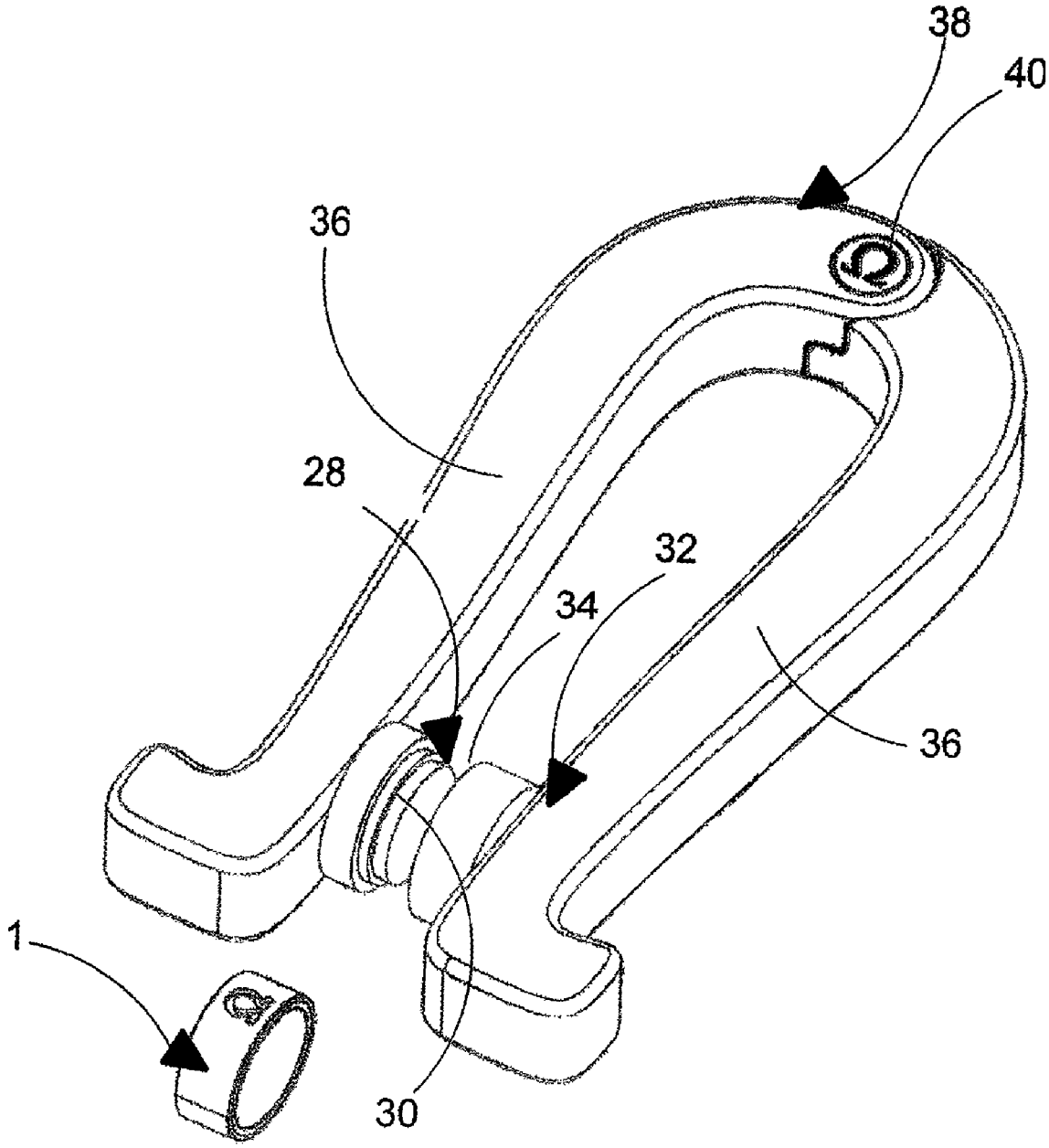
FIG. 7 is a perspective view of pliers for partially dismantling the two rings.

Outer ring 2 is held axially relative to inner ring 4 by at least one, and preferably, two balls 10 arranged in two housings 12 adjacent one end of the outer periphery of inner ring 4 as shown in FIG. 3. These two housings 12 are arranged on the same on the same diameter D of inner ring 4 and are preferably, but not restrictively, spaced at 180° from each other. As regards balls 10, these are preferably made of a ceramic material to prevent problems of corrosion, but other materials such as a metallic material could also be envisaged.

Ring 1 according to the invention is mounted in the following manner. Outer ring 2 is placed on inner ring 4 and rotated until an aperture 6 is facing one of housings 12. One of balls 10 is then inserted in its housing 12 passing through aperture 6. Outer ring 2 is then rotated through 180° so that aperture 6 is facing the second housing 12 that is still unoccupied. This pivoting movement of outer ring 2 relative to inner ring 4, while one of balls 10 is already in its housing 12, is made possible owing to the fact that said outer ring 2 has, on its inner periphery, a circular recess 14 with a cross section in the shape of an arc of a circle. Indeed, it can be seen upon examining the drawings, that circular recess 14 forms above ball 10 an arch whose highest point is higher than the tip of ball 10 arranged in its housing 12. Thus, when outer ring 2 is rotated relative to inner ring 4, ball 10 travels under the arch formed by circular recess 14. When aperture 6 is opposite the second housing 12, the corresponding ball 10 can be inserted in this housing 12.

Once the two balls 10 have been inserted in their respective housings 12, outer ring 2 is then rotated to bring two diametrically opposite recesses 16 arranged in the inner periphery of said outer ring 2 to face these two balls 10. These two recesses 16 are provided for pushing outer ring 2 axially on inner ring 4 and causing the two balls 10 to penetrate a circular groove 18 arranged in the inner periphery of outer ring 2. This circular groove 18 forms a rolling path for the two balls 10 along which said balls 10 will be able to roll when outer ring 2 is rotated relative to inner ring 4.

Once recesses 16 are no longer at the level of balls 10, the assembly formed by the two outer 2 and inner 4 rings cannot be dismantled. There remains however a risk that by manipulating the two rings 2, 4 and pushing on outer ring 2, the wearer could return the two recesses 16 to the level of balls 10 and succeed in separating the two rings 2 and 4.

This is why, in order to make them impossible to separate, one of the two rings 2 or 4 is provided with at least one pivot 20, which will travel in a circular groove 22 arranged in the opposite ring. In the example shown in the drawing, we have chosen, in a non-limiting manner, to pierce two holes 24 in inner ring 4, circular groove 22 being arranged in the inner periphery of outer ring 2. These two holes 24 will each receive a pivot 20 driven therein. Once the pivots 20 have been inserted, they can, in a non-limiting manner, be soldered and then polished to make them invisible.

According to a variant, the pivots are secured in a removable manner, for example by screws. The ring will then be impossible to dismantle for anyone except a jeweller who, with a suitable tool, will be able to unscrew the pivots. Afterwards, the jeweller can shift the rings relative to each other as far as the balls allow to remove, for example using bellows, the dirt (dust, grains of sand or suchlike) which have become mixed between the two rings and which obstruct their rotational movement.

It will be noted that pivots 20 have lateral play and axial play with circular groove 22 in which they travel, in order to prevent any friction.

A cavity 26 is arranged at least one place along the perimeter of circular groove 18, in which one or other of the two balls 10 can be housed. These cavities 26 are used for indexing the position of outer ring 2 relative to inner ring 4 by defining two predetermined stable positions of said outer ring 2 in which the apertures 6, 6' allow the decorations 8 on inner ring 4 to appear. In these positions, a slightly higher torque will have to be exerted in order to remove the ball 10 concerned from cavity 26 and to pivot said outer ring 2 relative to said inner ring 4.

It goes without saying that the present invention is not limited to the embodiment that has just been described and that various simple alterations and variations can be envisaged by those skilled in the art without departing from the scope of the invention as defined by the annexed claims. In particular, one could envisage applying the invention to making a bracelet to be worn around the wrist, earrings, cufflinks, key rings, pendants and more generally any piece of jewellery comprising an outer ring and an inner ring arranged concentrically to the outer ring, both rings being able to rotate in relation to each other.

The invention also concerns an accessory for dismantling ring 1 according to the invention. In its simplest form, this accessory comprises a plate 28 with a circular shoulder 30 against which the inner ring 4 abuts and whose diameter is fitted to that of said inner ring 4. Once ring 1 is arranged on plate 28, it is capped by a punch 32 of generally cylindrical shape which abuts via its circular base 34 against outer ring 2 of said ring 1. One then need only exert pressure on punch 32, for example by means of a staking tool (not shown). This pressure will be communicated to outer ring 2 which can then shift axially in relation to inner ring 4 held in position by plate 28 within the limits of movement allowed by balls 10. In a preferred variant, plate 28 and punch 32 will be fixed in relation to each other onto the two arms 36 of a pair of pliers 38 hinged so as to pivot at 40. It goes without saying that this accessory can only be used if ring 1 is not provided pivot or has a removable pivot.

What is claimed is:

1. An accessory for dismantling a piece of jewellery, wherein the accessory is positioned to dismantle the piece of jewellery, wherein the piece of jewellery includes (a) an outer ring; and (b) an inner ring arranged concentrically to the outer ring, wherein the inner ring and the outer ring are pivotable in relation to each other, wherein the outer ring comprises (i) at least one aperture through which at least one decoration, provided on an outer periphery of the inner ring, is visible; and (ii) means for axial coupling of the inner ring and the outer ring, wherein the means for axial coupling includes at least one ball arranged in a housing, adjacent one end of the outer periphery of the inner ring and distant form the center of outer periphery of the inner ring, wherein the at least one ball is rollable in an inner periphery of the outer ring and the inner periphery of the outer ring forms a rolling path for the at least one ball, wherein the accessory includes:

(1) a plate with a circular shoulder against which the inner ring of the piece of jewellery abuts and the circular shoulder has a diameter fitted to that of the inner ring of the piece of jewellery; and (2) a punch of cylindrical shape that abuts via a circular base thereof against the outer ring of the piece of jewellery when the accessory operates to dismantle the piece of jewellery.

2. The accessory according to claim 1, wherein the plate and the punch are fixed in relation to each other onto the two arms of a pair of pivotably hinged pliers.

3. A piece of jewellery including:

(a) an outer ring; and (b) an inner ring arranged concentrically to the outer ring, wherein the inner ring and the outer ring are pivotable in relation to each other, wherein the outer ring comprises i. at least one aperture through which at least one decoration, provided on an outer periphery of the inner ring, is visible;

ii. means for axial coupling of the inner ring and the outer ring, wherein the means for axial coupling includes at least one ball arranged in a housing disposed on the outer periphery of the inner ring and the at least one ball is rollable in an inner periphery of the outer ring and the inner periphery of the outer ring forms a rolling path for the at least one ball, wherein the outer ring has a circular recess on the inner periphery of the outer ring for assembly on the inner ring, wherein the circular recess defines an arch whose highest point is higher than the top of the ball arranged in its housing.

4. The piece of jewellery according to claim 3, wherein the outer ring includes on the inner periphery thereof at least one recess which enables the ball to penetrate the groove when said outer ring is pushed axially onto the inner ring.

5. A piece of jewellery including:

(a) an outer ring; and (b) an inner ring arranged concentrically to the outer ring, wherein the inner ring and the outer ring are pivotable in relation to each other, wherein the outer ring comprises i. at least one aperture through which at least one decoration, provided on an outer periphery of the inner ring, is visible;

ii. means for axial coupling of the inner ring and the outer ring, wherein the means for axial coupling includes at least one ball arranged in a housing disposed on the outer periphery of the inner ring and the at least one ball is rollable in an inner periphery of the outer ring and the inner periphery of the outer ring forms a rolling path for the at least one ball, wherein one of the inner ring and the outer ring is fitted with at least one pivot, wherein the pivot travels in a circular groove arranged on the one of the inner ring and the outer ring so as to face the other one of the inner ring and the outer ring.

6. The piece of jewellery according to claim 5, wherein the pivot has axial play and radial play with the circular groove.

7. The piece of jewellery according to claim 6, wherein the pivot is fixed in a removable manner.

8. The piece of jewellery according to claim 6, wherein the pivot is driven into a hole pierced in the inner ring or the outer ring that carries the same.

9. The piece of jewellery according to claim 5, wherein the pivot is fixed in a removable manner.

10. The piece of jewellery according to claim 5, wherein the pivot is driven into a hole pierced in the inner or outer ring that carries the same.

11. A piece of jewellery including:

(a) an outer ring; and (b) an inner ring arranged concentrically to the outer ring, wherein the inner ring and the outer ring are pivotable in relation to each other, wherein the outer ring comprises i. at least one aperture through which at least one decoration, provided on an outer periphery of the inner ring, is visible; and ii. means for axial coupling of the inner ring and the outer ring, wherein the means for axial coupling includes at least one ball arranged in a housing, adjacent one end of the outer periphery of the inner ring and distant from the center of the outer periphery of the inner ring, wherein the at least one ball is rollable in an inner periphery of the outer ring and the inner periphery of the outer ring forms a rolling path for the at least one ball, wherein at least one indexing cavity, in which the ball can be housed, is arranged at one place on the perimeter of a circular groove, wherein the circular groove is located on one end of the inner periphery of the outer ring, wherein one of the two rings is fitted with at least one pivot, and the pivot is fixed in a removable manner.

12. A piece of jewellery, including:

(a) an outer ring; and (b) an inner ring arranged concentrically to the outer ring, wherein the inner ring and the outer ring are pivotable in relation to each other, wherein the outer ring comprises i. at least one aperture through which at least one decoration, provided on an outer periphery of the inner ring, is visible; and ii. means for axial coupling of the inner ring and the outer ring, wherein the means for axial coupling includes at least one ball arranged in a housing, adjacent one end of the outer periphery of the inner ring and distant from the center of the outer periphery of the inner ring, wherein the at least one ball is rollable in an inner periphery of the outer ring and the inner periphery of the outer ring forms a rolling path for the at least one ball, wherein the ball is made of a ceramic material, wherein one of the two rings is fitted with at least one pivot, and the pivot is fixed in a removable manner.

13. A piece of jewellery including:

(a) an outer ring; and (b) an inner ring arranged concentrically to the outer ring, wherein the inner ring and the outer ring are pivotable in relation to each other, wherein the outer ring comprises i. at least one aperture through which at least one decoration, provided on an outer periphery of the inner ring, is visible; and ii. means for axial coupling of the inner ring and the outer ring, wherein the means for axial coupling includes at least one ball arranged in a housing, adjacent one end of the outer periphery of the inner ring and distant from the center of the outer periphery of the inner ring, wherein the at least one ball is rollable in an inner periphery of the outer ring and the inner periphery of the outer ring forms a rolling path for the at least one ball, wherein at least one indexing cavity, in which the ball can be housed, is arranged at one place on the perimeter of a circular groove, wherein the circular groove is located on one end of the inner periphery of the outer ring, wherein one of the two rings is fitted with at least one pivot, and the pivot is driven into a hole pierced in the inner ring or the outer ring that carries the same.

14. A piece of jewellery including:

(a) an outer ring; and (b) an inner ring arranged concentrically to the outer ring, wherein the inner ring and the outer ring are pivotable in relation to each other, wherein the outer ring comprises i. at least one aperture through which at least one decoration, provided on an outer periphery of the inner ring, is visible; and ii. means for axial coupling of the inner ring and the outer ring, wherein the means for axial coupling includes at least one ball arranged in a housing, adjacent one end of the outer periphery of the inner ring and distant from the center of the outer periphery of the inner ring, wherein the at least one ball is rollable in an inner periphery of the outer ring and the inner periphery of the outer ring forms a rolling path for the at least one ball, wherein the ball is made of a ceramic material, wherein one of the two rings is fitted with at least one pivot, and the pivot is driven into a hole pierced in the inner or outer ring that carries the same.

* * * * *